US008154367B2

(12) United States Patent
Nishikawa et al.

(10) Patent No.: US 8,154,367 B2
(45) Date of Patent: Apr. 10, 2012

(54) SWITCH AND SWITCH DEVICE USING SAME

(75) Inventors: Hisashi Nishikawa, Shiga (JP); Naoki Yoshikawa, Fukui (JP)

(73) Assignee: Panasonic Corporation, Osaka (JP)

( * ) Notice: Subject to any disclaimer, the term of this patent is extended or adjusted under 35 U.S.C. 154(b) by 243 days.

(21) Appl. No.: 12/266,689

(22) Filed: Nov. 7, 2008

(65) Prior Publication Data

US 2009/0121816 A1 May 14, 2009

(30) Foreign Application Priority Data

Nov. 14, 2007 (JP) ..... 2007-295434

(51) Int. Cl.
*H01H 9/00* (2006.01)

(52) U.S. Cl. ..... 335/206; 335/215

(58) Field of Classification Search ..... 335/205–207, 335/215; 340/547; 324/207.21
See application file for complete search history.

(56) References Cited

U.S. PATENT DOCUMENTS

| | | | | | |
|---|---|---|---|---|---|
| 3,486,144 | A | * | 12/1969 | Paige | 335/206 |
| 3,656,181 | A | * | 4/1972 | Pack | 335/205 |
| 3,873,957 | A | * | 3/1975 | Wurscher et al. | 338/32 H |
| 6,097,272 | A | * | 8/2000 | Grover et al. | 335/205 |
| 2004/0095218 | A1 | * | 5/2004 | Wan et al. | 335/207 |

FOREIGN PATENT DOCUMENTS

JP 2006-092777 A 4/2006

* cited by examiner

*Primary Examiner* — Bernard Rojas
(74) *Attorney, Agent, or Firm* — RatnerPrestia

(57) ABSTRACT

Regarding a switch used for various controls of a motor vehicle in particular and a switch device using the switch, it becomes possible to simplify the configuration and to perform reliable detection of trouble. A first detector is disposed on a surface opposing to a magnet fitted to an actuator, and a second detector is disposed thereunder. A controller detects magnetism of the magnet by using the first detector and the second detector. In case one of the detectors is out of order, it can also be detected from ON/OFF signal from the first detector and the second detector.

5 Claims, 8 Drawing Sheets

SWITCH AND SWITCH DEVICE USING SAME

BACKGROUND OF THE INVENTION

1. Field of the Invention

The present invention relates to a switch used for turning a stop lamp on/off for example when a brake pedal of a motor vehicle is operated in particular, and a switch device using the switch.

2. Background Art

Recently, a pressure type switch is used as a switch for transmitting the operation of a brake pedal to a controller. When the operation of the brake pedal depressed is transmitted, the controller serves to turn on a stop lamp. With the brake pedal released, the controller serves to turn off the stop lamp.

Such a conventional switch is described with reference to FIG. 7 and FIG. 8. FIG. 7 is a sectional view of conventional switch 11. In the figure, casing 12 includes case 1 and cover 10. Case 1 is made of insulating resin and opens upward in the figure. Cover 10 is made of insulating resin and disposed so as to cover the opening of case 1. Cylinder 10A is disposed at the upper part of cover 10. Actuator 2 and spring 9 are disposed in casing 12. Actuator 2 is installed in such manner as to be vertically movable in cylinder 1A. In the figure, coil spring 9 is disposed between a hollow portion of actuator 2 and bottom 1A of case 1. Due to restoring force of resilient spring 9, actuator 2 is pressed against cover 10. End 2A of actuator 2 is protruded upward from cylinder 10A.

Casing 12 is internally provided with magnet 3 and detector 6 in such manner as to be opposed to each other. Magnet 3 is disposed on the lower side surface of actuator 2. Detector 6 is formed of Hall Element and the like and disposed on wiring board 5. On wiring board 5 are disposed switching part 7 such as transistor or the like, and controller 8 formed of FET and a plurality of fixed resistors, etc. As to a plurality of terminals 4 made of conductive metal, one end thereof is connected to wiring board 5, and the other end is protruded outside the casing 12 from hole 1B of bottom 1A. Wiring patterns are provided on the right and left surfaces of wiring board 5. Terminal 4, detector 6, switching part 7, and controller 8 are electrically connected via the wiring patterns. These electronic parts are electrically connected by using solder or the like.

FIG. 8 shows a state of above-mentioned switch 11 mounted in a motor vehicle. Switch 11 and arm 30A are fitted to holding member 36. Arm 30A and holding member 36 are connected to each other on fulcrum 30B of arm 30A. Brake pedal 30 is attached to the tip of arm 30A. Arm 30A and switch 11 are in contact with each other via the end 2A of actuator 2. Connector 31 is connected to switch 11. Terminal 4 shown in FIG. 7 connects to a stop lamp and ignition switch of the motor vehicle, battery, electronic circuits of the motor vehicle, etc. via lead wires 31A of connector 31.

In FIG. 8, the state of arm 30A and brake pedal 30 shown by solid line indicates a state obtained when brake pedal 30 is not depressed. The state of arm 30A and brake pedal 30 shown by broken line indicates a state obtained when brake pedal 30 is depressed.

In this case, switch 11 shown in FIG. 7 changes as described in the following when brake pedal 30 is depressed. When brake pedal 30 is not depressed, the pressing force is applied downward in FIG. 7 to the end 2A of actuator 2. In other words, actuator 2 is in a state of being pressed downward. Magnet 3 disposed on the side surface of actuator 2 moves downward along with actuator 2. When brake pedal 30 is pressed, magnet 3 confronted detector 6, and when brake pedal 30 is not depressed, magnet 3 is positioned far away from detector 6. Consequently, the magnetism of magnet 3 detected by detector 6 becomes very weak.

Controller 8 operates as follows in accordance with the intensity of magnetism detected by detector 6.

When the magnetism detected exceeds the specified value, controller 8 detects that switch 11 is ON. As a result, controller 8 sets switching part 7 to ON and turns on the stop lamp. When the magnetism detected is less than the specified value, controller 8 detects that switch 11 is OFF. As a result, controller 8 sets the switching part 7 to OFF and turns off the stop lamp.

As described above, with actuator 2 depressed downward, the magnetism detected by detector 6 is very weak, that is, the magnetism is less than the specified value. Accordingly, controller 8 detects that switch 11 is OFF, then it sets the switching part 7 to OFF and turns off the stop lamp.

When brake pedal 30 is depressed, the inside of switch 11 shown in FIG. 7 becomes as described in the following. When brake pedal 30 is depressed, arm 30A moves apart from the end 2A of actuator 2. As a result, the pressing force applied to actuator 2 by means of arm 30A is released, and then, due to the restoring force of resilient spring 9, actuator 2 is moved upward. The condition is shown in FIG. 7. At the time, magnet 3 disposed on the side surface of actuator 2 moves upward along with actuator 2. As a result, magnet 3 and detector 6 become opposed to each other, intensifying the magnetism of magnet 3 detected by detector 6. In other words, the magnetism detected by detector 6 becomes higher than the specified value, and controller 8 detects that switch 11 is ON. And controller 8 sets switching part 7 to ON and turns on the stop lamp.

That is, conventional switch 11 operates as follows. Actuator 2 vertically moves in cylinder 10A in accordance with the operation of brake pedal 30. Magnet 3 disposed on the side surface of actuator 2 moves along with actuator 2. The magnetism detected by detector 6 varies in accordance with the movement of magnet 3. When the magnetism detected by detector 6 is higher than the specified value, controller 8 detects that switch 11 is ON. When the magnetism detected by detector 6 is less than the specified value, controller 8 detects that switch 11 is OFF. In accordance with the detection result of controller 8, controller 8 sets the switching part 7 to ON/OFF, and turns on/off the stop lamp.

As prior art, for example, Unexamined Japanese Patent Publication No. 2006-92777 is known.

Incidentally, in case of trouble with detector 6, the value transmitted from detector 6 to controller 8 becomes constant. Consequently, even when actuator 2 moves upward or downward, only a signal showing that switch 11 is OFF is transmitted from detector 6 to controller 8. That is, in the case of conventional switch 11, actuator 2 is pressed, and therefore, it is unable to detect whether OF is detected by detector 6 or OFF is detected because of trouble with detector 6.

SUMMARY OF THE INVENTION

The switch comprises a casing, an actuator which is movable in a predetermined direction with respect to the casing, a magnet fixed to the actuator, a first detector which is fixed in the casing for detecting the magnetism generated from the magnet, and a second detector for detecting the magnetism, which is disposed in a position a specified distance apart along the predetermined direction from the first detector.

By using such a switch, it is possible to simplify the configuration and to detect troubles in the first detector and the second detector with great accuracy.

DETAILED DESCRIPTION OF PREFERRED EMBODIMENTS

Figure 1:
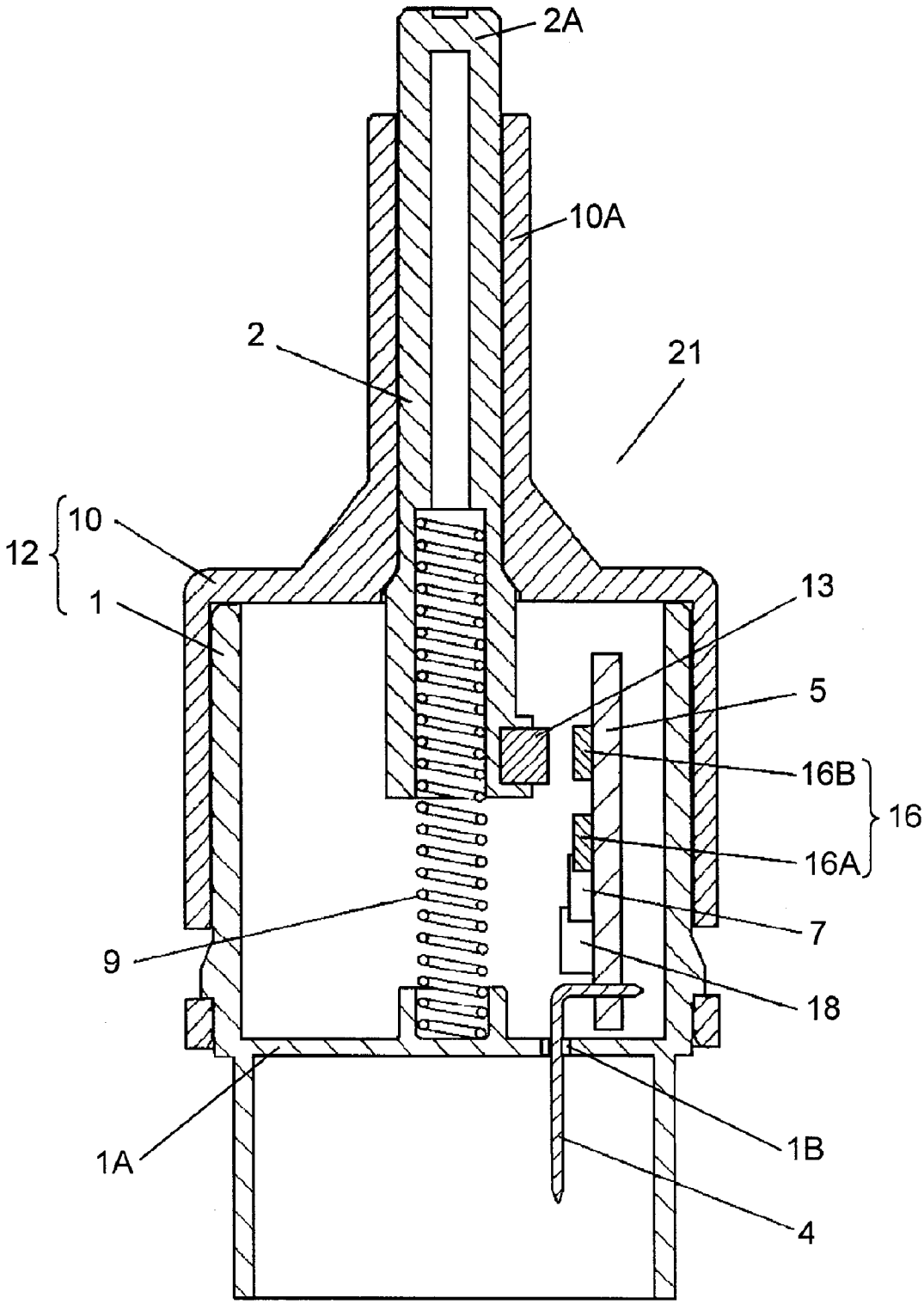
FIG. 1 is a sectional view of a switch in the first embodiment of the present invention.

The switch and switch device in the first embodiment of the present invention will be described in the following with reference to the drawings.

The same components as those described in the background art are given same reference numerals, the contents of which are incorporated herein.

First Embodiment

Figure 2:
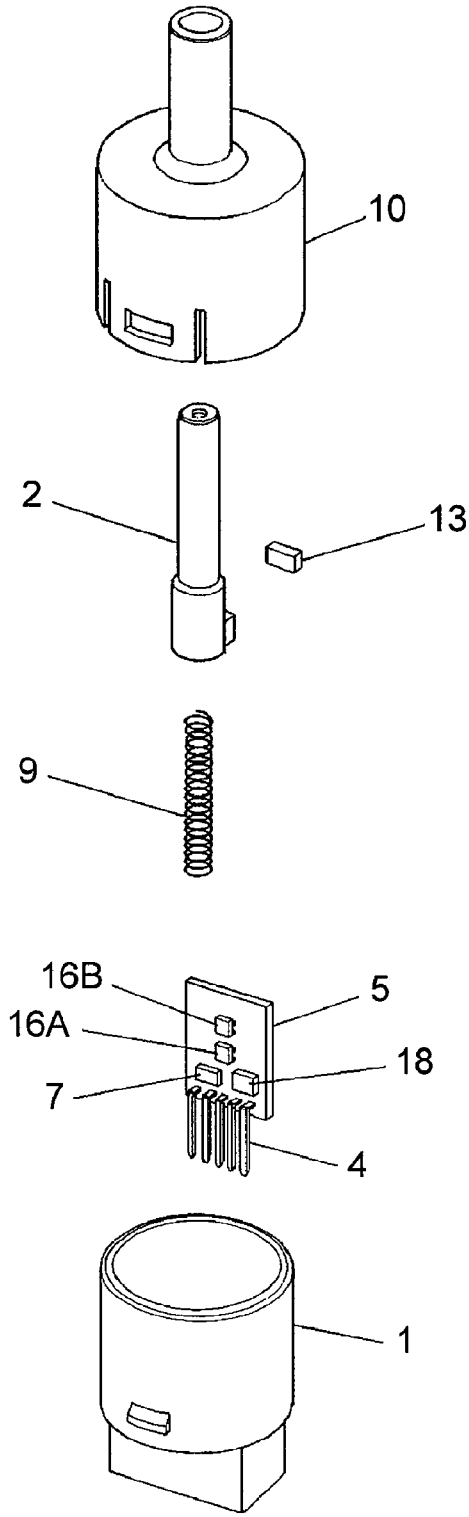
FIG. 2 is an exploded perspective view of a switch in the first embodiment of the present invention.

FIG. 1 is a sectional view of a switch according to a first embodiment of the present invention. FIG. 2 is an exploded perspective view according to the first embodiment of the present invention. In FIG. 1 and FIG. 2, casing 12 is formed of case 1 and cover 10. Case 1 is made of insulating resin and opens upward in the figure. Cover 10 is made of insulating resin and disposed so as to cover the opening of case 1. As insulating resin, polybutylene terephthalate or ABS (Acrylonitrile Butadiene Styrene) or the like can be used. Cylinder 10A is disposed at the upper part of cover 10. Actuator 2 and coil-shaped spring 9 are disposed in casing 12. Actuator 2 is cylindrical and made of insulating resin such as polybutylene terephthalate and ABS or the like. Actuator 2 is installed in such manner as to be vertically movable in cylinder 11A so that can move in the predetermined direction with respect to casing 12. A prescribed direction where actuator 2 moves with respect to casing 12 is called the predetermined direction. In the first embodiment of the present invention, actuator 2 moves the inside of cylinder 10A in the vertical direction in FIG. 1. That is, the vertical direction becomes the predetermined direction. The predetermined direction may satisfy the following conditions. Actuator 2 moves in a constant direction. It enters the state where detector 6 detects or not detect magnetism of magnet 3 according to the movement of actuator 2.

In FIG. 1, spring 9 is disposed between the hollow portion of actuator 2 and bottom 1A of case 1. Due to the restoring force of resilient spring 9, actuator 2 is pressed against cover 10. End 2A of actuator 2 is protruded upward from cylinder 1A. Spring 9 is just required to have restoring force and therefore it is preferable to be any other spring or resilient member having restoring force Casing 12 is internally provided with magnet 13 and detector 16 in such manner as to be opposed to each other. Detector 16 has detector 16A as a first detector and detector 16B as a second detector. Detector 16A is in a position opposing to magnet 13 when brake pedal 30 is not depressed. Detector 16B is in a position opposing to magnet 13 when bake pedal 30 is depressed. Magnet 13 is fixed to the surface of actuator 2. In the first embodiment, magnet 13 is disposed on the lower side surface of actuator 2. Detector 16A and detector 16B are formed of Hall Elements, SMR Elements (Semiconductor MagnetoResistive Elements) or the like, and disposed on wiring board 5. Switching part 7 such as transistors or the like, and controller 18 formed of FET and a plurality of fixed resistors, etc, are disposed on wiring board 5. As to a plurality of terminals 4 made of conductive metal such as copper alloy, one end thereof is connected to wiring board 5, and the other end is protruded outside the casing 12 from hole 1B of bottom 1A. Wiring patterns are provided on the right and left surfaces of wiring board 5. Terminal 4, detector 16A, detector 16B, switching part 7, and controller 18 are electrically connected via the wiring patterns. These electronic parts are electrically connected by using solder or the like.

Switch 21 having such a configuration will be described in detail with reference to FIG. 3A and FIG. 3B.

Figure 3A:
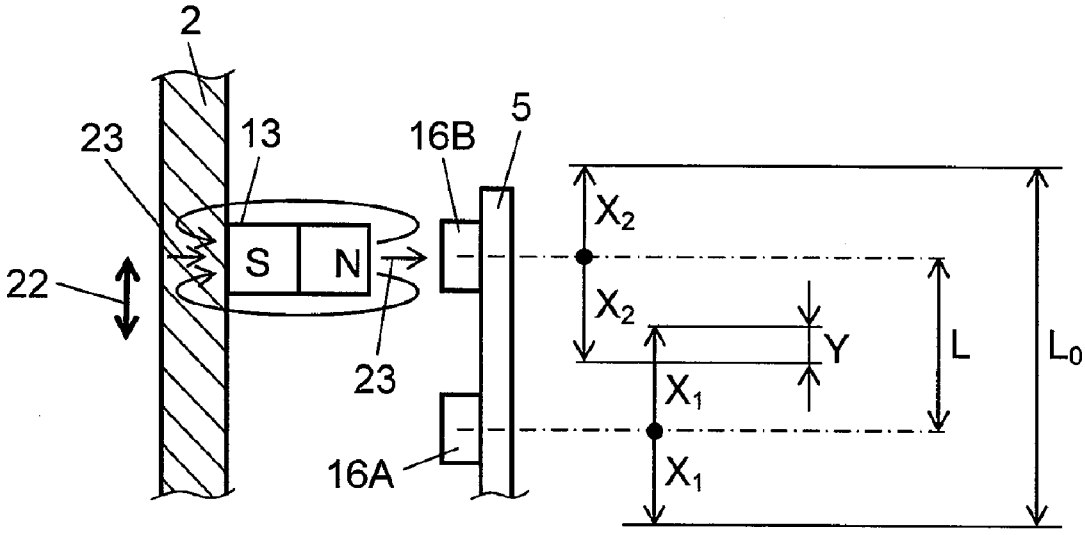
FIG. 3A is an explanatory diagram of an essential portion of a switch in the first embodiment of the present invention.

Actuator 2 moves along the predetermined direction 22 shown in FIG. 3A. The relative positions between magnet 13 and detector 16A change along predetermined direction 22. Magnet 13 includes an S pole and an N pole in a direction intersecting the predetermined direction 22. Since magnet 13 generates a flow of magnetism from the N pole to the S pole, as shown in FIG. 3A, the N pole is preferable to be disposed at detector 16A, detector 16B.

Detector 16A and detector 16B are disposed along the same direction as predetermined direction 22. Accordingly, the S pole and the N pole of magnet 13 are desirable to be arranged in a direction intersecting the predetermined direction 22. In this way, when magnet 13 is positioned before detector 16A and detector 16B, the strongest flow of magnetism 23 formed by the S pole and the N pole of magnet 13 can be supplied to detector 16A and detector 16B. It is more preferable to make the arrangement so that the S pole and the N pole of magnet 13 are perpendicular to predetermined direction 22.

Figure 3B:
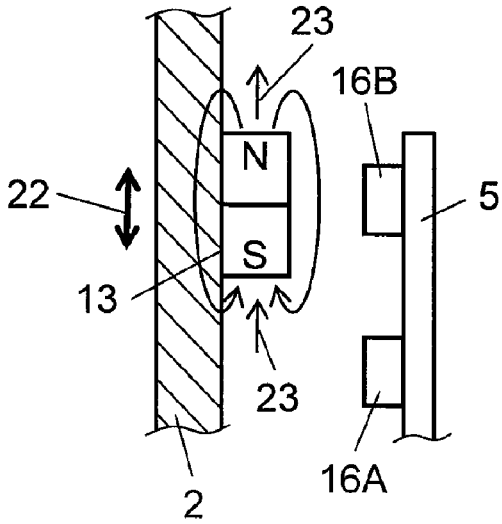
FIG. 3B is an explanatory diagram of an essential portion of a switch in the first embodiment of the present invention.

FIG. 3B shows an example of comparison with respect to the installing direction of magnet 13.

In FIG. 3B, magnet 13 is arranged so that the S pole and the N pole are in same direction as predetermined direction 22. In this case, the strongest flow of magnetism 23 formed by the S pole and the N pole of magnet 13 is generated in same direction as predetermined direction 22. As a result, in the arrangement shown in FIG. 3B, the strongest flow of magnetism 23 formed by the S pole and the N pole of magnet 13 cannot be supplied to detector 16A and detector 16B.

As is obvious in the result of comparison described above, when the S pole and the N pole of magnet 13 are disposed in a direction perpendicular to predetermined direction 22 in the arrangement, the strongest flow of magnetism 23 formed by the S pole and the N pole of magnet 13 can be supplied to detector 16A and detector 16B. In other words, magnetism generated from magnet 13 can be efficiently transmitted to detector 16A and detector 16B. As a result, the accuracy of detecting the position of magnet 13 can be enhanced. Also, since the magnetism can be efficiently transmitted from magnet 13 to detector 16A and detector 16B, it enables the size reduction of magnet 13, detector 16A, and detector 16B.

Next, as shown in FIG. 3A, detector 16A and detector 16B are installed in positions where the following formulas are satisfied.

$$X1<L<X1+X2$$

$$X2<L<X1+X2$$

X1 shows the maximum distance at which detector 16A is able to detect magnetism. X2 is the maximum distance at which detector 16B is able to detect magnetism. L shows the distance between the centers of detector 16A and detector 16B. That is, distance L between centers is longer than maximum distances X1, X2 at which detectors 16A and 16B respectively detect magnetism. And, it is shorter than the value satisfied by detector 16A and detector 16B with respect to the distance at which each of them is able to detect magnetism. Also, the detail will be described later, but there is provided section Y in which both of detectors 16A and 16B are able to detect magnetism.

In the above arrangement, either detector 16A or detector 16B is able to detect the magnetism generated from magnet 13 in movement range L0 of magnet 13.

In other words, monitoring the output of detector 16A or detector 16B, in case the detection of magnetism cannot be confirmed from any one of detector 16A and detector 16B simultaneously, it can be detected that at least one of detector 16A and detector 16B is in trouble.

That is, the configuration is very simple and it is possible to obtain switch 21 capable of detecting abnormality such that detector 16A or detector 16B is out of order.

Particularly, as shown in FIG. 3A, there is provided section Y where both detectors 16, detector 16A and detector 16B, are able to detect magnetism. Due to such section Y provided, the detection of trouble can be reliably performed in the entire region where magnetism generated from magnet 13 is detected by detector 16A and detector 16B.

Specifically, suppose that the maximum distance at which detector 16A and detector 16B are able to detect magnetism is X1, X2=2.6 mm. The central distance between detector 16A and detector 16B installed is L=4.2 mm. In this way, the movement of magnet 13 can be detected over the entire length L0 =6.8 mm. Particularly, in the section where detector 16 for detecting the magnetism of magnet 13 is changed over from detector 16A to detector 16B, there is provided section Y where the magnetism is detected by both of detector 16A and detector 16B. In section Y, a sufficient distance is ensured including variation of characteristics of the elements configuring detector 16A and detector 16B. In such a configuration, the position of magnet 13 can be more reliably detected. With respect to the specific example described above, the inventor ensures section Y=1 mm.

Switch 21 showing the first embodiment of the present invention is installed in a motor vehicle.

Figure 8:
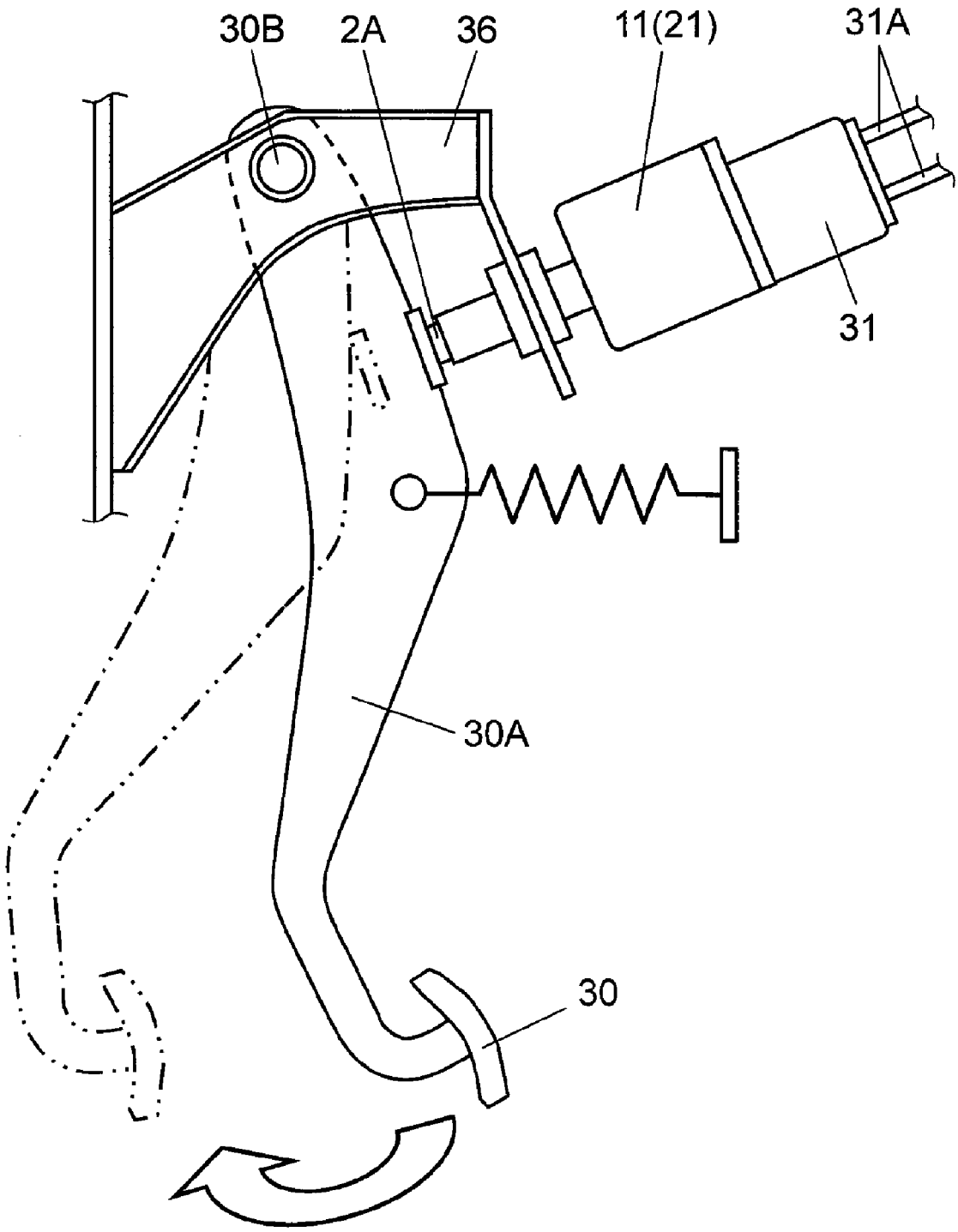
FIG. 8 is a side view of an essential portion of a conventional brake pedal.

For the description of such an installation, the above description of FIG. 8 is quoted. Also, the block circuit diagram of a switch device that can be configured by installing switch 21 in a motor vehicle is shown in FIG. 4.

Figure 4:
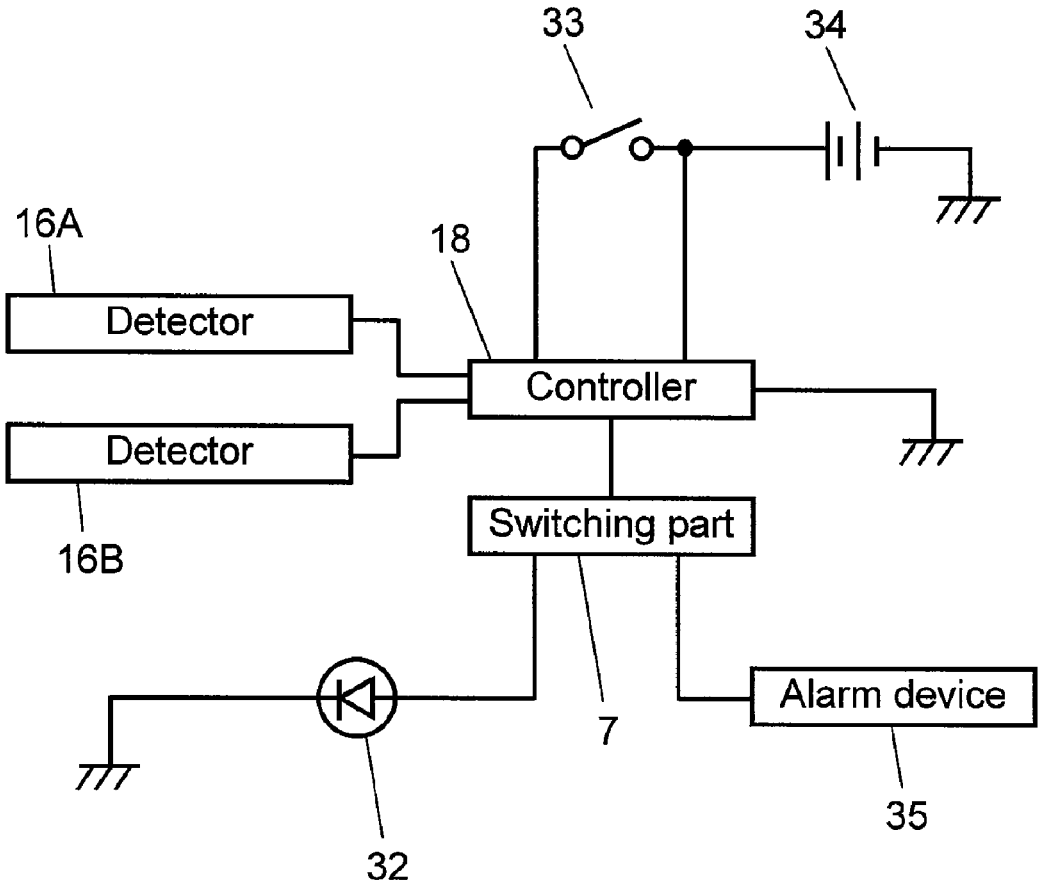
FIG. 4 is a block circuit diagram of a switch device in the first embodiment of the present invention.

In FIG. 4, when ignition switch 33 is set to ON, power is supplied from battery 34 to controller 18. With power supplied, controller 18 checks detector 16A and detector 16B. Controller 18 turns ON and OFF the switching part 7 in accordance with the state of detection, and controls the operation of turning on/off stop lamp 32 formed of a lamp or light-emitting diode and the like. Also, when controller 18 detects abnormality, it turns on the switching part 7, and for example, it gives an instruction to alarm device 35 formed of a warning lamp or buzzer and the like so that the person is informed of the abnormality.

By using FIG. 1, FIG. 5 and FIG. 6A to FIG. 6C, the procedure for detecting the state of brake pedal 30 being pressed will be described.

Figure 5:
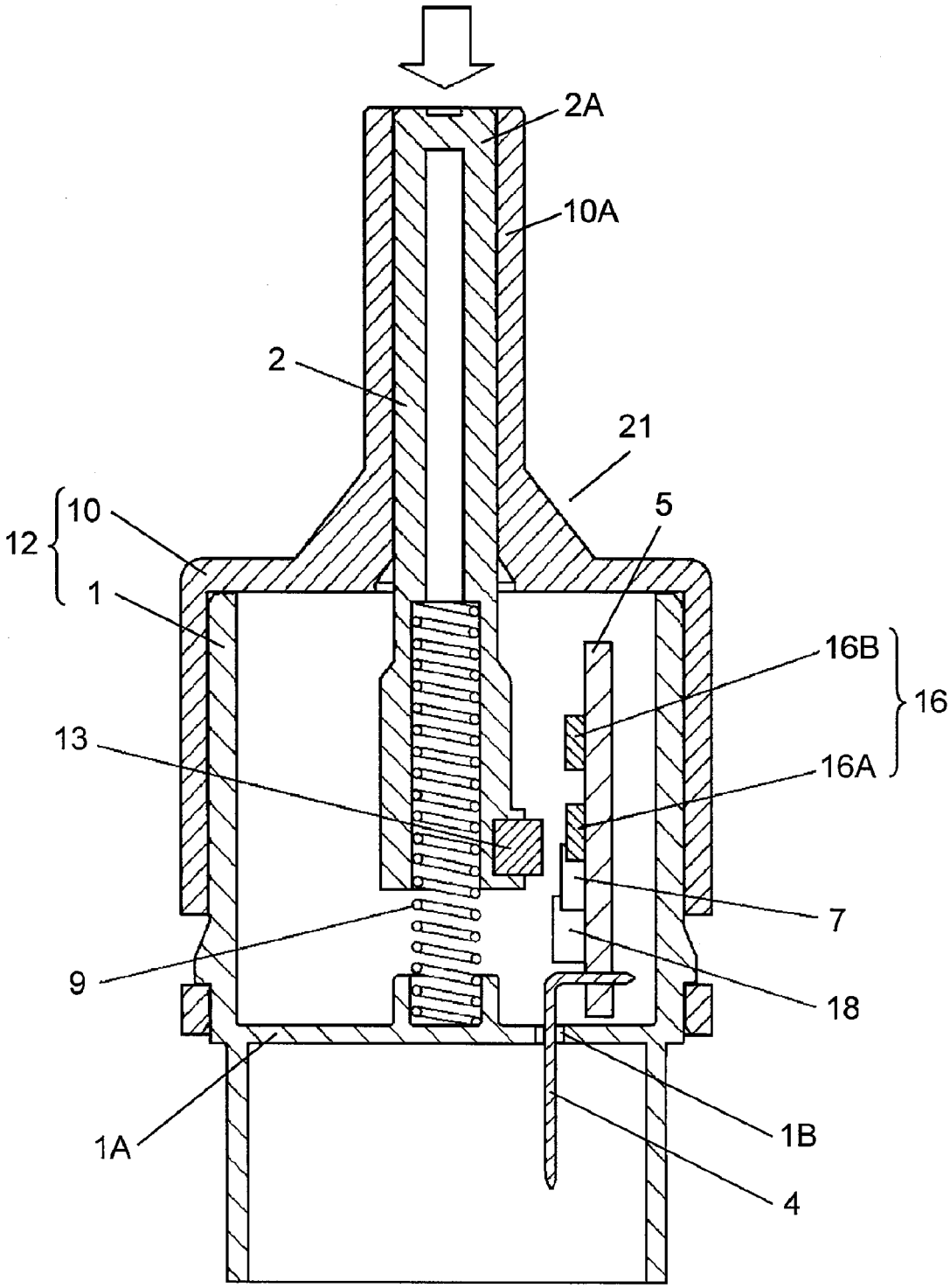
FIG. 5 is a sectional view of a switch in the first embodiment of the present invention.

FIG. 5 shows a state of brake pedal 30 not pressed. As against the specific example described above, it shows that actuator 2 is being pressed by 6 mm. In this case, actuator 2 is pressed downward by means of arm 30A. As actuator 2 moves downward, magnet 13 disposed on the lower side surface of actuator 2 also moves downward. Then, the relationship between magnet 13, detector 16A and detector 16B is as shown in FIG. 6A.

Figure 6A:
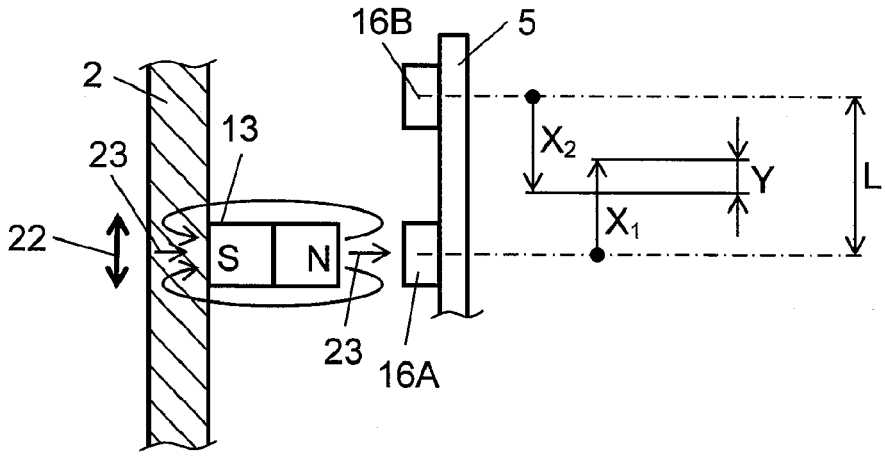
FIG. 6A is an explanatory diagram of an essential portion of a switch in the first embodiment of the present invention.

FIG. 6A shows the state of actuator 2 pressed. In this condition, magnet 13 fixed to actuator 2 is positioned at the starting point of the movement in predetermined direction 22. As shown in FIG. 6A, magnet 13 is positioned close to detector 16A. In this case, detector 16A detects high magnetism generated from magnet 13. That is, since the magnetism detected by detector 16A is higher than the specified value, ON signal is transmitted to controller 18. On the other hand, detector 16B is at a position farther than the maximum distant X2 at which the magnetism of magnet 13 can be detected, and therefore, it is unable to detect the magnetism generated from magnet 13. That is, since the magnetism detected by detector 16B is lower than the specified value, OFF signal is transmitted to controller 18. Controller 18 receives ON signal from detector 16A and OFF signal from detector 16B, and detects that brake pedal 30 is not depressed. And, controller 18 sets the switching part 7 to OFF and turns off the stop lamp 32.

Next, when brake pedal 30 is depressed, the pressing force applied to actuator 2 is released. Consequently, switch 21 operates to change the position of actuator 2 from FIG. 5 to FIG. 1. The relationship between magnet 13, detector 16A and detector 16B changes from FIG. 6A to FIG. 6C via FIG. 6B.

Figure 6B:
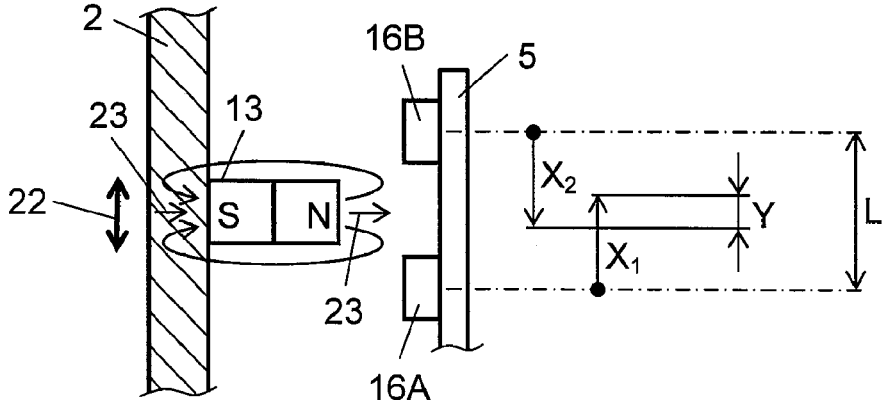
FIG. 6B is an explanatory diagram of an essential portion of a switch in the first embodiment of the present invention.

The state of FIG. 6B is described in the following. FIG. 6B shows a state that magnet 13 is passing the middle between detector 16A and detector 16B. When magnet 13 moves from the position of FIG. 6A to the position of FIG. 6B, the magnetism of magnet 13 that can be detected by detector 16A becomes lowered. On the other hand, detector 16B is unable to detect the magnetism of magnet 13 in the state of FIG. 6A, but it becomes able to detect the magnetism of magnet 13 in the state of FIG. 6B. In this case, both of detector 16A and detector 16B detect magnetism higher than the specified value. And, both of detector 16A and detector 16B transmit ON signal to controller 18. As a result, controller 18 detects that brake pedal 30 is in a transient state. Controller 18 keeps the switching part 7 set at OFF and the stop lamp 32 turned off.

Figure 6C:
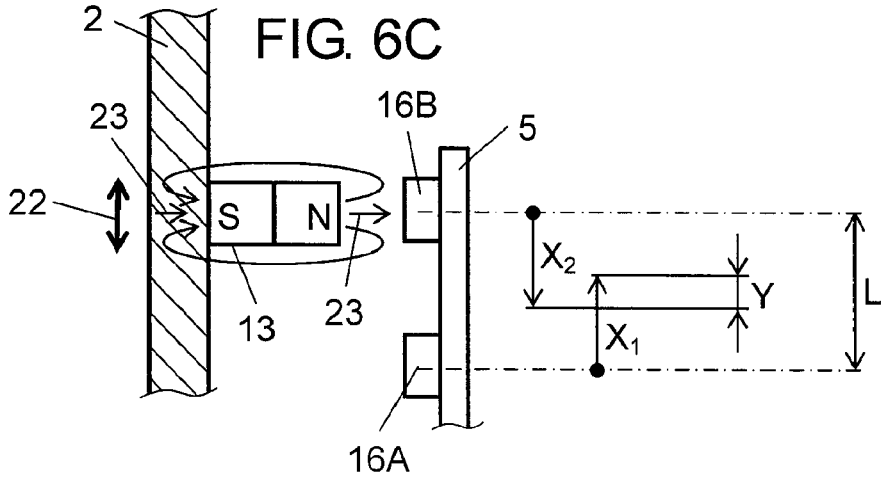
FIG. 6C is an explanatory diagram of an essential portion of a switch in the first embodiment of the present invention.
Figure 7:
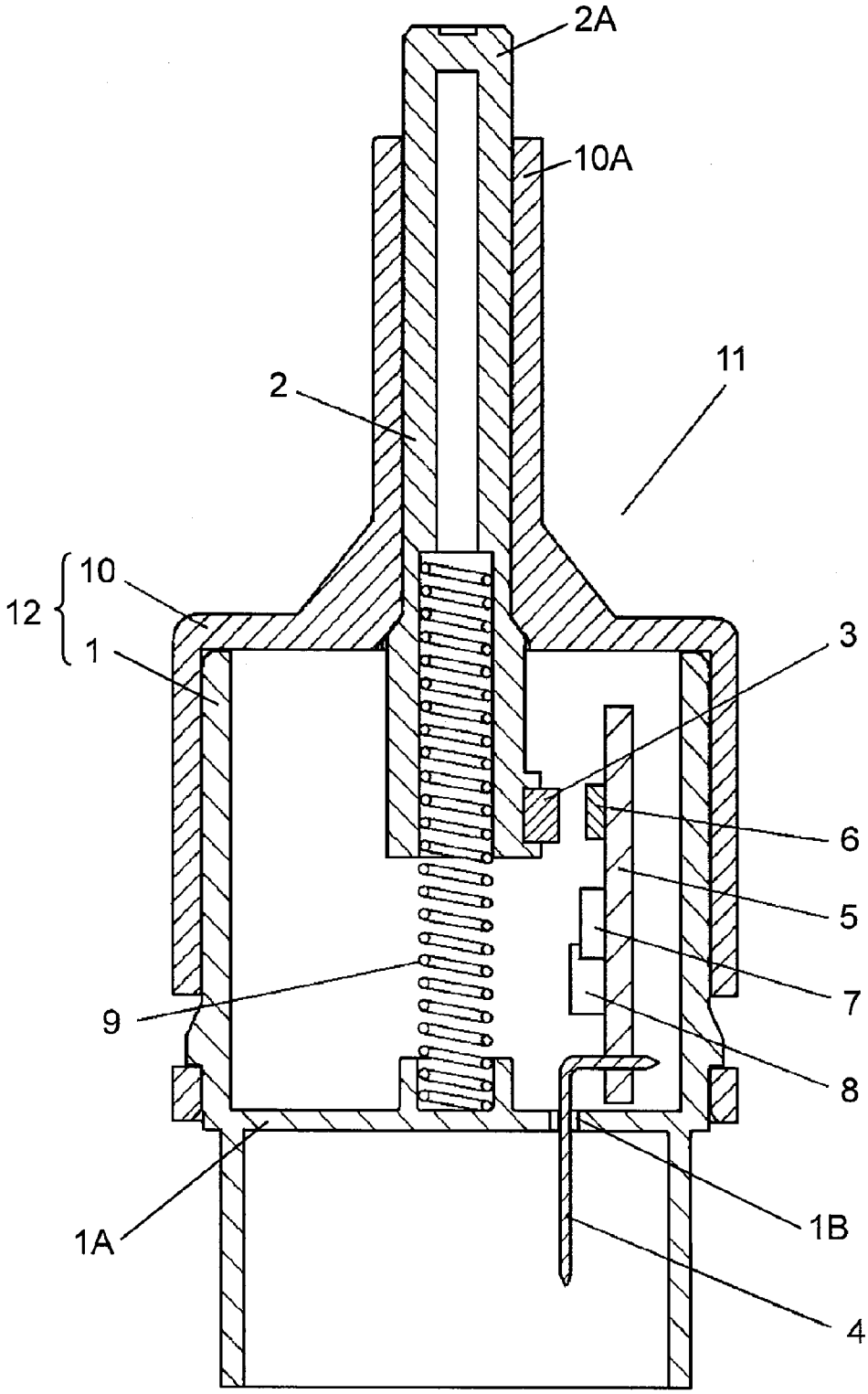
FIG. 7 is a sectional view of a conventional switch.

After that, as a result of depressing the brake pedal 30, switch 21 is shifted to the state shown in FIG. 1 and FIG. 6C.

In the process from FIG. 6B to FIG. 6C, as magnet 13 moves farther away from detector 16A, the magnetism of magnet 13 detected by detector 16A becomes lower. On the other hand, the magnetism of magnet 13 detected by detector 16B becomes higher. And, when the magnetism detected by detector 16A becomes lower than the specified value, detector 16A transmits OFF signal to controller 18. During the range from receiving the OFF signal from detector 16A until reaching the state of FIG. 6C, controller 18 detects that brake pedal 30 is in a state of being depressed. That is, receiving ON signal from detector 16B and OFF signal from detector 16A, controller 18 sets the switching part 7 to ON and turns on the stop lamp 32. FIG. 6C shows a state that actuator 2 is pressed against cover 10. This condition shows that magnet 13 fixed to actuator 2 is positioned at the end of movement in predetermined direction 22.

In the first embodiment of the present invention described above, particularly in the section where the magnetism detecting element changes over from detector 16A to detector 16B, it is possible to obtain the following advantages by providing section Y where both detection regions overlap each other.

The trouble in detector 16A and detector 16B can be detected in the entire range where the position of magnet 13 is detected by detector 16A and detector 16B. When a trouble is generated in detector 16A and detector 16B, controller 18 detects that abnormality has been generated.

As described above, detector 16A and detector 16B, when magnet 13 comes close to them, transmits ON signal to controller 18 to inform it of the position of magnet 13. Controller 18 detects ON/OFF signal from detector 16A and detector 16B, and thereby, it detects whether there exists pressing force against actuator 2. Detecting whether there exists pressing force against actuator 2, controller 18 determines the state of depression of brake pedal 30.

As is obvious in the above description, when ignition switch 33 is ON, detector 16A and detector 16B always transmit ON signal according to the position of magnet 13 to controller 18 from at least one of detectors 16.

Accordingly, OFF signal is not usually transmitted to controller 18 from both of detector 16A and detector 16B.

In other words, when ignition switch 33 is ON, in case OFF signal is transmitted to controller 18 from both of detector 16A and detector 16B simultaneously, it can be detected that one of detectors 16 is out of order.

Specifically, the detail is as follows. In normal condition, when brake pedal 30 is not pressed as shown in FIG. 6A, ON signal is transmitted to controller 18 from detector 16A, and OFF signal is transmitted to controller 18 from detector 16B. However, when detector 16A is out of order, OFF signal is transmitted to controller 18 from both of detector 16A and detector 16B. Controller 18 receiving the OFF signal from both of detector 16A and detector 16B determines that detector 16 is out of order and operates the alarm device 35 via switching part 7.

Similarly, in normal condition, when brake pedal 30 is depressed as shown in FIG. 6C, Off signal is transmitted to controller 18 from detector 16A, and ON signal is transmitted to controller 18 from detector 16B. However, in case detector 16B is out of order, OFF signal is transmitted to controller 18 from both of detector 16A and detector 16B. Controller 18 receiving the OFF signal from both detector 16A and detector 16B determines that detector 16A and detector 16B are out of order and operates the alarm device 35 via switching part 7.

Particularly, in the first embodiment, when magnet 13 passes between detector 16A and detector 16B as shown in FIG. 6B, ON signal is usually transmitted to controller 18 from both of detectors 16A, 16B. Thus, since the ranges of detection by detector 16A and detector 16B are overlapped each other, the state of transmitting OFF signal to controller 18 from both of detector 16A and detector 16B can be avoided, and thereby, it is possible to simplify the configuration and to perform highly reliable detection of trouble over the entire range of movement of magnet 13.

Controller 18 performs the detection of brake pedal 30 depressed, on/off control of stop lamp 32, and detection of trouble in detector 16 on the basis of ON signal and OFF signal transmitted from detector 16A and detector 16B. That is, as the elements used for detector 16, similar advantages can be obtained by using elements having same characteristics. By using the element in common for detector 16A and detector 16B, it is possible to easily set up the switch 21 without problems such as use of a wrong part.

Detector 16A and detector 16B are arranged distance L apart from each other, and magnet 13 is arranged so that the N pole or the S pole is vertically faced to detector 16A or detector 16B. In such a configuration, for example, switch 21 can be configured even in case magnet 13 is as small as about 3 mm in height, 5 mm in length, and 2 mm in thickness. Moreover, in this configuration, even in case of using two detectors (detector 16A and detector 16B), the overall height of switch 21 can be relatively decreased.

The size of switch 21 can be more reduced by using neodymium type magnet 13 being high in remanent magnetic flux density, and for detector 16A and detector 16B, Hall Element whose sensitivity is not high enough to detect magnetism when the flux density is 10 mT or less.

Detector 16A and detector 16B are disposed on the surface opposing to magnet 13 fixed to actuator 2. Controller 18 uses detector 16A and detector 16B to detect the magnetism of magnet 13. In use of this first embodiment, controller 18 detects the ON/OFF signal detected by detector 16A and detector 16B, and thereby, it is possible to obtain a switch which is structurally simple and capable of reliable detection of trouble, and a switch device using the switch.

In the above description, controller 18 executes the on/off control of stop lamp 32 by using detector 16A and detector 16B. Unlike the configuration described above, it is also preferable to be configured in that controller 18 sets the switching part 7 to ON when brake pedal 30 is not depressed and sets the switching part 7 to OFF when brake pedal 30 is depressed. And the present invention can be realized by connecting such a switch to the electronic circuit of a motor vehicle for example in order to achieve the purpose of controlling an auto-cruise or the like that keeps the running speed of the motor vehicle constant.

In the above description, controller 18 and switching part 7 are integrated with switch 21 in the configuration. It is also preferable to use a configuration in which such components are included in the electronic circuit of a motor vehicle, while only detector 16A and detector 16B are disposed on wiring board 5.

The switch and the switch device based on the first embodiment of the present invention are structurally simplified and capable of reliable detection of trouble. The switch and the switch device are useful for on/off control of a stop lamp of a motor vehicle.

What is claimed is:

1. A switch comprising:

a casing;

an actuator movable in a predetermined direction with respect to the casing;

a magnet fixed to the actuator;

a first detector fixed to the casing, the first detector being adapted to detect magnetism generated from the magnet; and a second detector disposed at a position apart from the first detector by a predetermined distance along the predetermined direction, the second detector being adapted to detect magnetism generated from the magnet, wherein the magnet moves along the predetermined direction, and a movable range of the magnet is limited between a first point and a second point, and the predetermined distance is determined, such that when the magnet is positioned at the first point, the first detector detects the magnetism, while the second detector does not detect the magnetism, when the magnet is positioned at the second point, the first detector does not detect the magnetism, while the second detector detects the magnetism, and at every position of the magnet between the first point and the second point, either the first detector or the second detector detects the magnetism.

2. The switch of claim 1, wherein the magnet is arranged so that an N pole and an S pole are positioned in a direction intersecting the predetermined direction.

3. A switch device comprising:

a casing;

an actuator which is movable in a predetermined direction with respect to the casing;

a magnet fixed to the actuator;

a first detector fixed to the casing, the first detector being adapted to detect magnetism generated from the magnet;

a second detector disposed at a position apart from the first detector by a predetermined distance along the predetermined direction, the second detector being adapted to detect magnetism generated from the magnet; and a controller for detecting relative positions between the actuator and the casing, and for detecting an abnormality of the first detector and an abnormality of the second detector from a detection result of the first detector and a detection result of the second detector, wherein the magnet moves along the predetermined direction, and a movable range of the magnet is limited between a first point and a second point, and the specified distance is determined, such that when the magnet is positioned at the first point, the first detector detects the magnetism, while the second detector does not detect the magnetism, when the magnet is positioned at the second point, the first detector does not detect the magnetism, while the second detector detects the magnetism, and at every position of the magnet between the first point and the second point, either the first detector or the second detector detects the magnetism.

4. The switch device of claim 3, wherein the controller detects that the abnormality is generated when the first detector and the second detector do not detect the magnetism simultaneously.

5. The switch device of claim 3, further comprising an alarm device which gives an alarm when the controller detects the abnormality of the first detector or the abnormality of the second detector from detection results of the first detector and detection results of the second detector.

* * * * *